United States Patent [19]

Robinson

[11] Patent Number: 4,723,657

[45] Date of Patent: Feb. 9, 1988

[54] MICROPHONE CARRYING CASE

[76] Inventor: Sandra Robinson, 3125 Old Hobart Rd., Lake Station, Ind. 46405

[21] Appl. No.: 37,389

[22] Filed: Apr. 10, 1987

[51] Int. Cl.[4] ..... A45C 11/00; B65D 85/00

[52] U.S. Cl. ..... 206/334; 190/109; 190/110

[58] Field of Search ..... 190/109, 110, 16; 206/223, 477, 480, 223, 328, 334, 372

[56] References Cited

U.S. PATENT DOCUMENTS

| | | | |
|---|---|---|---|
| 1,430,333 | 9/1922 | Smith | 190/109 |
| 1,705,150 | 3/1929 | Brady | 190/18 R |
| 2,825,208 | 3/1958 | Anderson | 190/109 |
| 3,926,308 | 12/1975 | Sullivan | 206/328 X |

FOREIGN PATENT DOCUMENTS

| | | | |
|---|---|---|---|
| 524582 | 5/1931 | Fed. Rep. of Germany | 190/109 |
| 858948 | 12/1952 | Fed. Rep. of Germany | 206/334 |
| 2854205 | 6/1980 | Fed. Rep. of Germany | 190/109 |
| 418241 | 10/1934 | United Kingdom | 206/372 |
| 1525155 | 9/1978 | United Kingdom | 206/328 |

*Primary Examiner*—William Price
*Attorney, Agent, or Firm*—Epstein & Edell

[57] ABSTRACT

Microphones having attached electrical cords are stored for transport in a carrying case by providing separate mutually isolated compartments for the cords to avoid inter-tangling of the cords. The microphones are engaged in spaced parallel relation on the carrying case lid with individual cord-storage compartments disposed to receive respective power cords. The engagement structure and compartments may be a permanent part of the carrying case, or may be an insert adapted to be selectively removable from the case. A novel engagement clip is fabricated from hard resilient plastic material and permits insertion of the microphone handle therein from the side of the clip so as to provide a barrier forwardly of the microphone that prevents the microphone from becoming disengaged as the case is opened and closed.

15 Claims, 9 Drawing Figures

MICROPHONE CARRYING CASE

BACKGROUND OF THE INVENTION

1. Technical Field

The present invention relates to carrying cases and, more particularly, to a carrying case and method for storing microphones with electrical cords.

2. Discussion of the Prior Art

Members of musical groups often have a need to store multiple microphones for transport between performances. In some instances the microphone cord is wrapped about the microphone handle and placed in a carrying case. It has been my experience that repeated wrapping of the cord about the microphone handle results in breakage or loosening of the wires inside the cord. Some individuals simply stuff the microphones and cords into a case with the result that the cords become tangled with one another. Apart from the time required to disentangle the cords, the disentanglement process often results in the wires becoming pulled loose from their connections to the microphones. I am unaware of any prior art which addresses these problems associated with microphone storage.

Although not concerned with microphone storage, U.S. Pat. No. 3,926,308 (Sullivan) discloses a tool carrying case specifically designed to accommodate a single elongated test tool for use by electrical power line maintenance personnel. The test tool has a cable secured to one end. The carrying case for the tool provides a tray on which the tool may be secured by a strap with the cable extending unconstrained along the tray. This arrangement is entirely unsuitable for carrying multiple microphones in view of the fact that the cords from the individual microphones would likely become tangled and present the problems described above.

Another problem concerning storage of microphones in a case relates to the manner in which the microphone is secured in place. For example, I have found that it is desirable to store microphones in a carrying case by attaching the microphones to the case lid by means of clips mounted on the lid. Conventional clips with resilient spaced arms projecting from the mounting surface may be used for this purpose; however, such clips present certain problems which are also addressed by the present invention. Specifically, as the case lid is being opened, the weight and inertia of the microphone engaged between the clip arms tends to urge the microphone away from the lid and out of engagement between the clip arms. The result is inadvertent disengagement of the microphone, accompanied by possible damage of the microphone and entanglement of the disengaged microphone and its cord with other microphones and cords stored in the case.

OBJECTS AND SUMMARY OF THE INVENTION

It is therefore an object of the present invention to provide a carrying case for plural microphones wherein the cords of different microphones are prevented from becoming tangled and wherein the potential for breakage and loosening of the wires in the cords is minimized.

It is another object of the present invention to provide a method for storing plural microphones in order to prevent the cords from different microphones from becoming tangled, and in order to minimize the potential for breakage and loosening of the wires in the cords.

It is a further object of the present invention to provide a resilient clip for securing a microphone to the inside surface of the lid of a carrying case, which clip permits the microphone to be easily inserted therein but prevents inadvertent disengagement of the microphone while the lid is being opened and closed.

In accordance with the present invention the inside surface of the carrying case lid serves as a mounting surface on which a plurality of microphones can be engaged with their cords stowed in respective mutually isolated compartments. The microphones are preferably secured with their handles extending perpendicular to the lid pivot axis so that the microphone cords are suspended downwardly along the mounting surface when the lid is in its open position. Each cord-receiving compartment is aligned with a respective microphone and may be a soft pouch or rigid box-like compartment disposed on the lid. Alternatively, the cords may be received in respective compartments located in the case body.

Selective engagement of each microphone is provided by respective clips, straps, etc., disposed on a forwardly-projecting strip so that the microphones may be engaged at their handles just below the enlarged microphone head, whereby a portion of the enlarged head extends rearwardly of the engagement structure. This feature minimizes the depth required for the clip itself in a dimension projecting forwardly of the lid mounting surface.

A preferred microphone mounting clip, according to the present invention, is made of hard resilient plastic or metal material and permits the microphone handle to be entered into the clip in a transverse direction from one side of the clip, and to be supported when engaged at its front and back so that the microphone cannot inadvertently be dislodged from the clip, particularly while the lid is being opened or closed. The clip includes four length sections including a first or mounting section secured flush against the lid mounting strip. A second length section extends forwardly from one end of the first section substantially perpendicular to the mounting surface. The third length section extends from the distal end of the second section and is substantially parallel to and spaced from the first section. A fourth length section extends from the third section and bends approximately 180 degrees to extend into the space between the first and third sections. This fourth section is arcuately contoured so as to at least partially conform to a portion of the periphery of a microphone handle while resiliently urging the handle against the first length section. In the preferred embodiment a strip of high-friction material is secured to the handle-engaging surface of the fourth length section to prevent longitudinal movement of the microphone handle while it is engaged in the clip.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein like reference numerals in the various figures are utilized to designate like components, and wherein.

DESCRIPTION OF THE PREFERRED EMBODIMENTS

Figure 1:
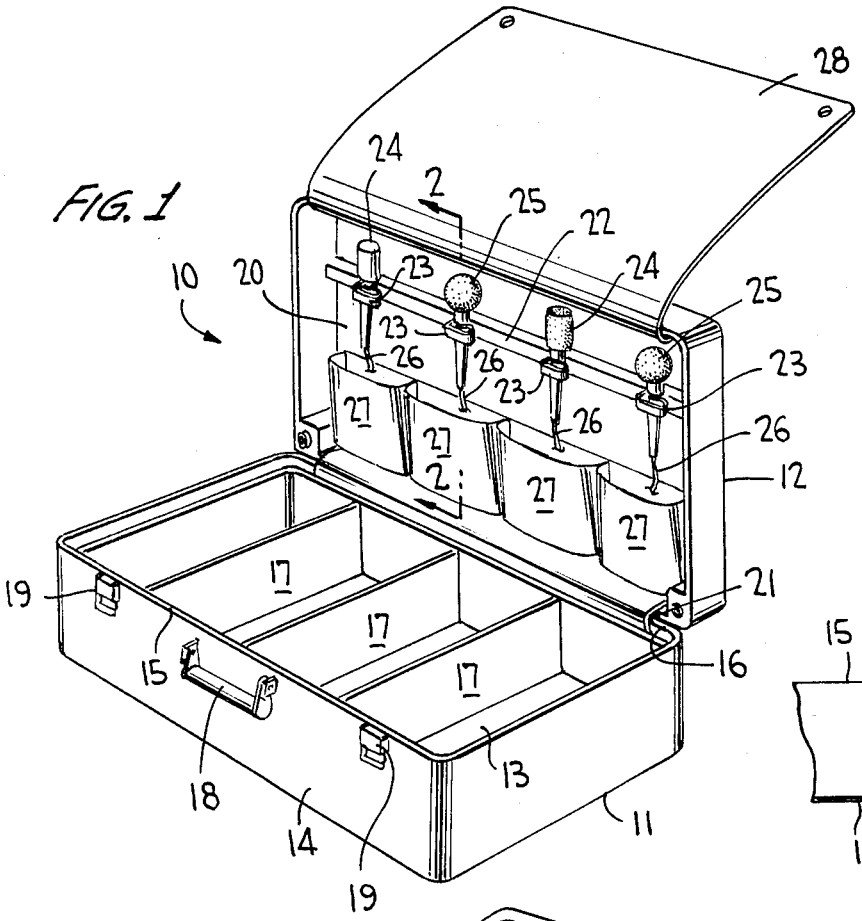
FIG. 1 is a view in perspective of one embodiment of a microphone carrying case constructed in accordance with the present invention.
Figure 2:
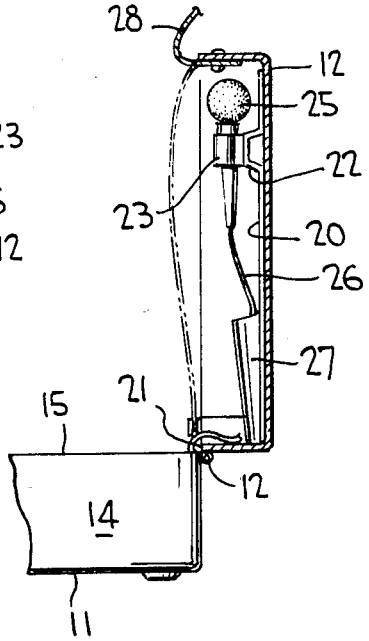
FIG. 2 is a view in section taken along lines 2—2 of FIG. 1.

Referring to FIGS. 1 and 2 of the accompanying drawings in greater detail, a carrying case 10 includes a main body 11 and a lid 12. The carrying case illustrated in FIG. 10 has its main body 11 and lid 12 configured generally rectangularly; however, it is to be understood that the present invention is not limited to rectangular carrying cases since the principles of the invention apply to substantially any configuration. Main body 11 has a recessed rectangular bottom surface 13 surrounded on all four sides by respective sidewalls 14. The tops of sidewall 14 form an edge 15 configured as a thin rectangular frame. One edge or side 16 of that frame is the rearward edge of main body 11 at which the lid 12 is pivotably secured by means of a hinge 17, or the like, in a conventional manner. The space defined between the sidewalls 14 and bottom surface 13 is subdivided into plural compartments (four compartments in the illustrated embodiment) by means of a plurality of partitions 17 extending front-to-back in the main body 11. A carrying handle 18 is provided on the front portion of sidewall 14 in a conventional manner. Likewise, portions 19 of fasteners are provided on the same sidewall section and are adapted to engage interlocking portions of fasteners provided on the front sidewall section of lid 12 in a conventional manner.

Lid 12 includes a recessed rectangular mounting surface 20 surrounded by sidewalls terminating in an edge which abuts edge 15 of the main body when the carrying case is closed. One section 21 of the lid edge is considered the bottom or rearward edge at which the lid is pivotably joined, by means of hinge 17, to the main body. Hinge 17, in this manner, provides a pivot axis extending transversely across the width dimension of the carrying case. A mounting strip 22 extends transversely across the entire mounting surface 20 at a location spaced from and parallel to bottom edge portion 21. Mounting strip 22 projects forwardly from mounting surface 20 to an extent and for the purposes described below.

A plurality of mounting clips 23 (four of which are shown in the illustrated embodiment) are secured on the forward facing surface of mounting strip 22 and are transversely aligned along that strip. Each mounting clip 23 is adapted to engage a respective microphone 24, 25. Typically, these microphones include an enlarged head portion from which an elongated handle depends. Clips 23 are adapted to engage the microphone handle proximate or adjacent the enlarged microphone head. The opposite end of the handle has an electrical microphone cord 26 extending therefrom. In the embodiment illustrated in FIGS. 1 and 2, the microphone cords 26 for each microphone are received in respective soft pouches disposed in adjacent alignment transversely across lid 12 at a location more proximate edge portion 21 than is the mounting strip 22. Each pouch 27 includes an open end facing a respective clip 23 so as to permit the cord of a microphone supported by that clip 23 to be received in the pouch. The pouch is closed on all sides and ends except for that top side which permits the microphone cord to be received in the pouch. Since each clip 23 has an associated pouch, each engaged microphone has a respective compartment in which the electrical cord of that microphone is received and isolated from the cords of the other microphones. The lid may be provided with a cover sheet 21 which can be selectively secured in place to cover the pouches 27 and clips 23 with microphones engaged therein.

As an alternative to providing pouches 27, the microphone cords 26 may be received in respective compartments 13 in main body 11. For this purpose compartments 13 may be positioned to be aligned with respective clips 23 in order to facilitate isolation of the cords of the engaged microphones. It is preferred, however, to provide compartments for the cords on the lid 12, in which case the compartments 13 in main body 11 may be used for storing miscellaneous equipment rather than the microphone cords.

The purpose of providing a forwardly-projecting mounting strip 22 is to permit the enlarged head of microphones 24, 25 to be received in clip 23 without requiring the clip itself to have an unnecessarily large depth dimension. In particular, and as best illustrated in FIG. 2, it is seen that a portion of the head of microphone 25 projects rearwardly of clip 23 toward mounting surface 20. If the projecting mounting strip 22 were not present, the depth of clip 23 would have to be sufficient to accommodate a portion of the microphone head rearwardly of the microphone engagement point on the handle of the microphone. Greater clip depth tends to reduce the resilient clamping force which engage the microphone. Mounting strip 22, therefore, permits a shorter clip depth with resulting greater clamping force.

Figure 3:
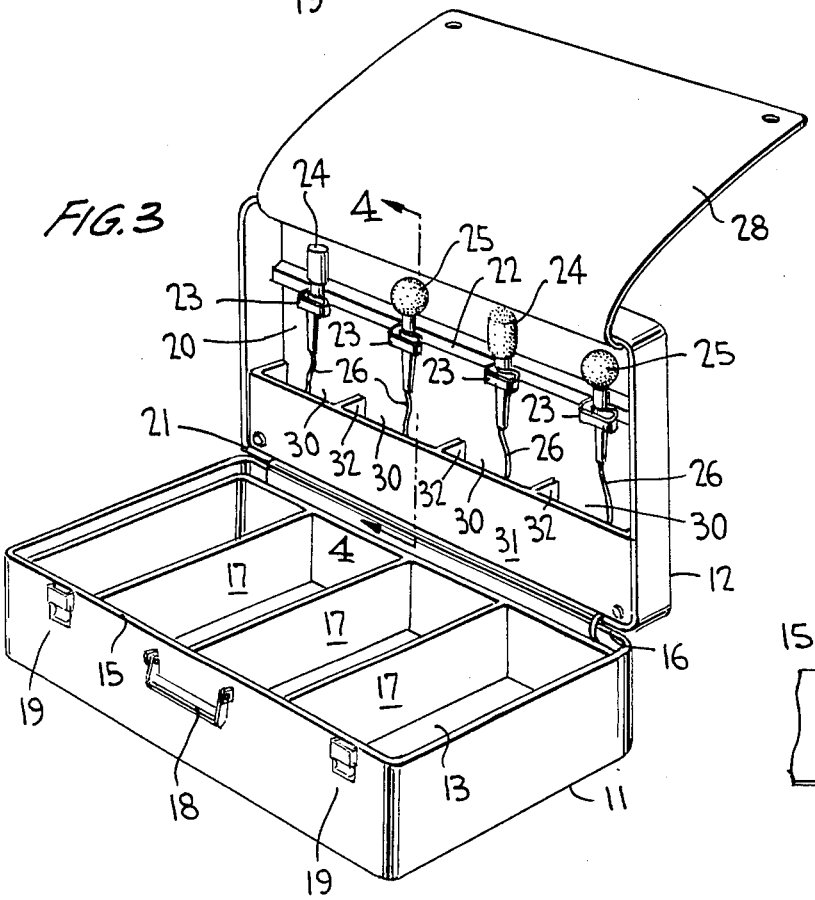
FIG. 3 is a view in perspective of another embodiment of a microphone carrying case constructed in accordance with the present invention.
Figure 4:
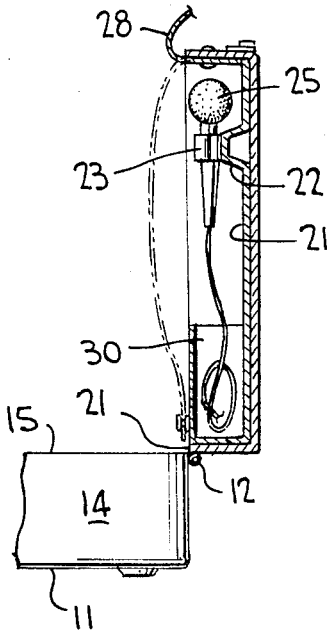
FIG. 4 is a view taken along lines 4—4 of FIG. 3.

An alternate embodiment of the present invention is illustrated in FIGS. 3 and 4. In this embodiment the compartments 30 for receiving individual microphone cords 26 take the form of respective rigid boxes 30 rather than the soft pouches 27. The compartments 30 are defined by a rigid panel 31 extending transversely across the lid proximate bottom edge 21 in spaced relation to the mounting surface 20. A plurality of partitions 32 define the spacing between panel 31 and surface 20 while also defining the individual compartments 30. Each compartment is open at its upper end to receive a respective microphone cord from the microphone engaged in a clip 23 aligned with the compartment opening.

Figure 5:
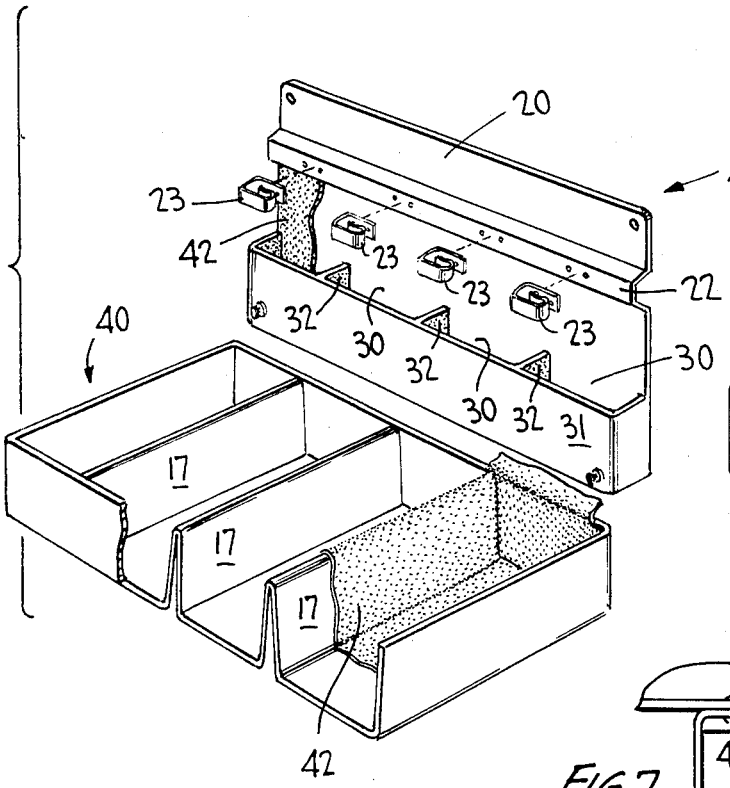
FIG. 5 is a view in perspective of two inserts constructed in accordance with the principles of the present invention and adapted to be inserted into a carrying case.

Another embodiment of the invention is illustrated in FIG. 5 and takes the form of a pair of inserts 40 and 41 adapted to be fit into and secured to the main body and lid, respectively of a carrying case. Specifically, insert 40 is a compartmentalized tray adapted to fit into the body member of a carrying case. Insert 40 is configured much like the interior of the main body 11 of the carrying case 10 of FIG. 1 and permits adaptation of a completely empty carrying case. Likewise, insert 40 contains the identical components to those mounted on mounting surface 20 in the embodiment of FIG. 3 but is configured in the form of an insert which is capable of modifying a totally empty lid in a carrying case. Inserts 40 and 41 may be glued to the main body and lid, respectively, of an empty carrying case; alternatively, Velcro strips may be employed to appropriately secure the inserts in place so that the inserts may be removable on demand. The inserts are preferably made of moldable plastic materials so that each insert can be fabricated as a single unit with only the clips 23 being secured to insert 41 as part of a separate assembly step. The plastic inserts may be covered with appropriate soft push material 42, if desired.

Figure 6:
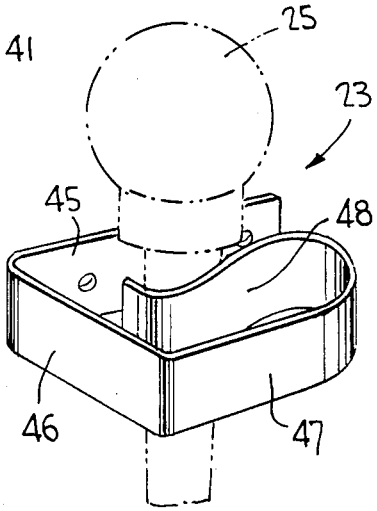
FIG. 6 is a view in perspective of a microphone engagement clip constructed in accordance with the present invention.
Figure 7:
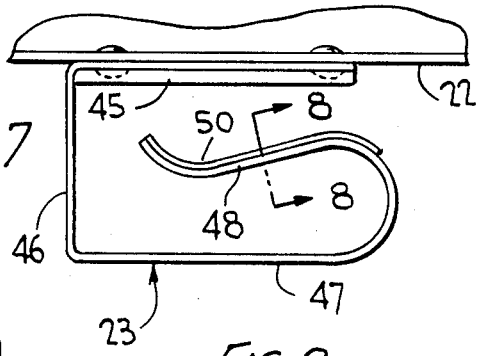
FIG. 7 is a top view in plan of the microphone engagement clip of FIG. 6 mounted on a mounting surface in one of the embodiments of FIGS. 1, 3 and 5.

Although clips 23 may take substantially any form suitable for holding the handle of a microphone, the form illustrated in FIG. 6 has been developed by me as part of the present invention and is particularly suited for the purpose of holding microphone handles. In particular, each clip 23 preferably takes the form of an elongated strip of hard resilient material bent into four successive length sections. In the preferred embodiment the clip is made from resilient plastic material, such as polyvinylchloride (PVC), or the like, although spring metal may similarly be utilized. A first length section 45 of the clip is adapted to be secured flush against the mounting strip 22 with its length extending parallel to mounting strip 22 and transversely of the carrying case lid. A second length section 46 extends at right angles from one end of length section 45 to project forwardly of the mounting strip 22 and mounting surface 20. The distal end of section 46 has a third section 47 extending at substantially right angles therefrom so as to be parallel to and spaced from the first section 45. Sections 45 and 47 thus enclose a space on three sides with the open side facing in a transverse direction relative to the carrying case lid. A fourth section 48 bends arcuately and continuously through approximately 180 degrees from the distal end of section 47 so as to extend back into the space between length sections 45 and 47. The surface 49 of section 48 facing mounting section 45 has an arcuate contour which curves in a direction opposite to the curvature at the juncture between sections 47 and 48. In other words, the arcuate curvature at the end of section 48 presents a concave face toward section 45. It is between this concave face and section 45 that the handle of a microphone is engaged. In this regard, the spacing between sections 45 and 48 is less than the diameter of the handle of the microphone proximate the enlarged head end of the microphone. The resilience of the clip at the bend points and curvature points permit the microphone handle to be slid into the space between sections 45 and 48 in a transverse direction by forcing these sections apart. The resilience of the structure then permits the microphone handle to be firmly engaged between sections 45 and 48. In order to prevent the handle of the microphone from slipping longitudinally when engaged in clip 23, the engagement surface 49 at clip section 48 may be provided with a coating or strip 50 of high-friction material, such as rubber, that contacts the microphone handle when the microphone is engaged. As illustrated in FIG. 7, the clip may be secured to mounting strip 22 by means of screws and bolts; alternatively, an adhesive material may be employed to secure the clip 23 to the mounting strip.

Figure 9:
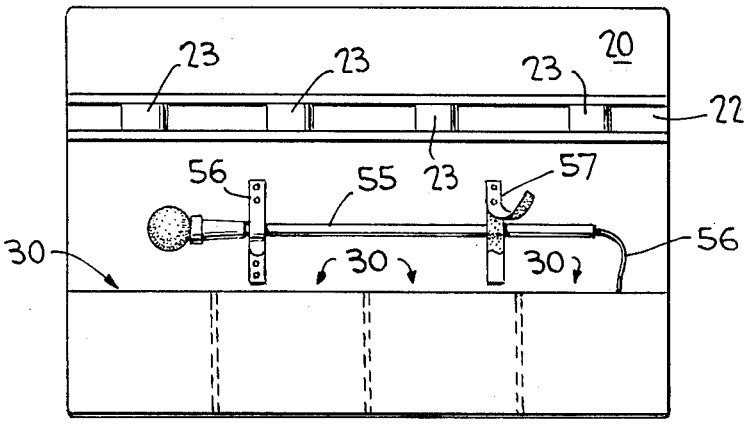
FIG. 9 is a view in plan of a modified insert for the lid of a carrying case modified, in accordance with the present invention, to accommodate and engage an additional microphone.
Figure 8:
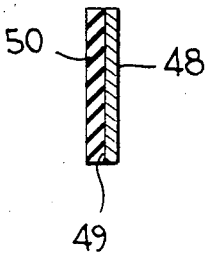
FIG. 8 is a view in section taken along lines 8—8 of FIG. 7.

As illustrated in FIGS. 2 and 4, the forward projection of mounting strip 22 relative to mounting surface 20 places the handles of microphones engaged by clips 23 in a forward spaced relation to mounting surface 20. This permits the space rearward of the microphone handles and cords 26 to serve as mounting space for other microphones. In particular, some microphones have relatively long handles and might not fit into a carrying case when oriented lengthwise of the case in the manner of microphones engaged by clip 23. One such elongated microphone is illustrated in the embodiment of FIG. 9 and is designated by the reference numeral 55. The handle of microphone 55 is engaged in two transversely-spaced locations by means of two respective pairs of straps 56, 57. Each pair of straps includes two separate strap members positioned above and below, respectively, the supported microphone 55 and adapted to engage one another by means of Velcro engagement (as illustrated), a buckle arrangement or any other conventional adjustable strap engagement. The straps hold the microphone 55 against mounting surface 20 with the handle of the microphone oriented transversely of the carrying case and behind the suspended handles of microphones engaged by clips 23. The cord 56 for microphone 55 may be received in one of the compartments 30 (as illustrated in FIG. 9) or in one of the compartments 13 in the main body 11 of case 10 (see FIG. 1).

Although the clip 23 illustrated in FIG. 6 is the preferred form of engaging microphones along mounting strip 22, it will be understood that other forms of microphone engagement may be utilized, such as a pair of straps similar to the strap pairs 56 or 57. From the foregoing description it will be appreciated that the invention makes available a novel carrying case for microphones of the type having electrical cords extending therefrom and permits the microphones to be stored without danger of breaking or tangling the microphone cords. In addition a unique clip is disclosed for engaging the microphone.

Having described preferred embodiments of the new and improved apparatus for storing microphones in accordance with the present invention, it is believed that other modifications, variations and changes will be suggested to those skilled in the art in view of the teachings set forth herein. It is therefore to be understood that all such variations, modification and changes are believed to fall within the scope of the present invention as defined by the appended claims.

What is claimed:

1. A carrying case for microphones and similar elongated articles having respective electric cords attached thereto, said case comprising:

a main body having at least one edge;

a lid member having a bottom edge pivotably engaged to said one edge of said main body to permit said lid member to be pivoted to selectively and alternatively expose and enclose an interior volume between said lid member and said main body, said lid member having an interior mounting surface facing inwardly of said interior volume when said interior volume is enclosed, said mounting surface being normally oriented in a substantially vertical plane when said interior volume is exposed;

a plurality of engagement means for engaging a respective plurality of microphones, said engagement means being secured to said mounting surface in a mutually transversely spaced alignment parallel to and spaced from said bottom edge, each engagement means being oriented to receive and engage a respective microphone with the longest dimension of the microphone extending substantially perpendicular to said transverse alignment and with the electrical cord for that microphone suspended from the lower most end of that microphone when lid member is oriented in said vertical plane; and a plurality of separate compartments, each compartment aligned with a respective a engagement means, for receiving the suspended electrical cord of a microphone engaged in the respective aligned engagement means, said compartments being mutually isolated from one another to prevent the electric power cords of different engaged microphone from becoming tangled with one another.

2. A carrying case according to claim 1 wherein said plurality of compartments are secured to said mounting surface in transverse alignment parallel to and spaced from said alignment of said engagement means, said compartments being disposed closer to said bottom edge than are said engagement means.

3. The carrying case according to claim 2 wherein each compartment is a pouch of flexible material having an open end facing a respective engagement means, a closed end opposite said open end, a pair of closed opposite sides extending between said open and closed ends, a rear side disposed adjacent said mounting surface, and a front side made of soft flexible material.

4. A carrying case according to claim 2 wherein each of said compartments has an open end facing a respective engagement means, a rigid closed end opposite said open end, and rigid front, rear and side surfaces, said rear surface being disposed adjacent said mounting surface.

5. The carrying case according to claim 2 further comprising an insert unit removably securable to said lid member inside said case, wherein said mounting surface is a surface of said insert unit, and wherein said plurality of engagement means and plurality of compartments are secured to said insert unit.

6. The carrying case according to claim 2 wherein said microphones include large head ends and a handle with a tail end from which said power cords extend, wherein said mounting surface includes means for forwardly projecting said engagement means from said lid member to permit engagement of said microphones at a location on said handle adjacent said enlarged head and while permitting said enlarged head and to extend rearwardly of said engagement means toward said mounting surface.

7. The carrying case according to claim 6 wherein said means for forwardly projecting comprises a transversely-elongated forwardly-projecting strip disposed on said mounting surface parallel to and spaced from said bottom edge of said lid member.

8. The carrying case according to claim 1 wherein said engagement means each comprise a pair of mutually engagable straps of flexible material for receiving a microphone between the straps and said mounting surface.

9. The carrying case according to claim 1 wherein said engagement means each comprises a clip of hard resilient material adapted to receive and engage a microphone.

10. The carrying case according to claim 9 wherein said clip comprises a strip of hard plastic material comprising four successive length sections including:

a first length section secured to and extending parallel to said mounting panel;

a second length section projecting forwardly of said mounting panel from said one end of said first length section;

a third length section extending from said second length section in generally parallel spaced relation to said first length section; and a fourth length section extending from said third length section and bending approximately 180 degrees to extend into the space between said first and third length sections and in spaced relation to said first and third length sections, said fourth length section having an engagement surface facing said first length section and being sufficiently resilient to permit transverse insertion of a microphone handle between said fourth length section and said first length section so as to be resiliently engaged against said first length section by said engagement surface of said fourth length section.

11. The carrying case according to claim 10 further comprising a strip of relatively high friction material disposed on said engagement surface of said fourth length section to minimize movement of any microphone handle disposed between said engagement surface and said first length section.

12. The carrying case according to claim 1 further comprising additional means secured to said mounting surface for engaging an additional microphone in an orientation transverse to the orientation of microphones engaged by said engagement means, said additional means comprising two transversely spaced means for engaging two respective locations along the length of said additional microphone.

13. The carrying case according to claim 1 wherein said plurality of compartments comprise a plurality of adjacent trays disposed in said main body, each tray being separated from an adjacent tray by a raised partition oriented generally perpendicular to said one edge of said main body.

14. Carrying case according to claim 1 further comprising additional storage compartment means disposed in said main body for storing miscellaneous items.

15. A carrying case for a microphone comprising:

a main body having at least one edge:

a lid member having a bottom edge pivotably engaged to said one edge of said main body to permit said lid member to be pivoted to selectively and alternatively expose and enclose an interior volume between said lid member and said main body, said lid member having an interior mounting surface facing inwardly of said interior volume when said interior volume is enclosed, and normally oriented in a substantially vertical plane when said interior volume is exposed;

a clip for supporting said microphone on said mounting surface, said clip comprising a strip of hard plastic material having four successive length sections including:

a first length section secured to said mounting panel;

a second length section projecting forwardly of said mounting panel from one end of said first length section;

a third length section extending from said second length section in generally parallel spaced relation to said first length section; and a fourth length section extending from said third length section and bending approximately 180 degrees to extend into the space between said first and third length sections and in spaced relation to said first and third length sections, said fourth length section having an engagement surface facing said first length section and being sufficiently resilient to permit a microphone to be inserted between said fourth and first length sections and being resiliently urged against said first length section by said engagement surface of said fourth length section.

* * * * *